United States Patent [19]

Patel

[11] 4,215,455

[45] Aug. 5, 1980

[54] REED OPENER ASSEMBLY

[75] Inventor: Dhiru Patel, Rockford, Ill.

[73] Assignee: Barber-Colman Company, Rockford, Ill.

[21] Appl. No.: 25,704

[22] Filed: Apr. 2, 1979

[51] Int. Cl.[2] ..... D03J 1/14

[52] U.S. Cl. ..... 28/204

[58] Field of Search ..... 28/203, 204, 205, 206, 28/207

[56] References Cited

U.S. PATENT DOCUMENTS

| | | | |
|---|---|---|---|
| 363,689 | 5/1887 | Sherman | 28/204 |
| 871,680 | 11/1907 | Field et al. | 28/204 |
| 1,190,245 | 7/1916 | Peterson | 28/205 X |
| 1,624,928 | 4/1927 | Colman | 28/204 |
| 2,696,654 | 12/1954 | Townsend | 28/203 |
| 3,412,442 | 11/1968 | Crandall et al. | 28/207 |
| 3,444,601 | 5/1969 | Wieneke | 28/204 |

FOREIGN PATENT DOCUMENTS

| | | | |
|---|---|---|---|
| 17562 | of 1899 | United Kingdom | 28/204 |

*Primary Examiner*—Robert Mackey
*Attorney, Agent, or Firm*—Robert M. Hammes, Jr.

[57] ABSTRACT

A reed opener assembly for spreading the dents of a reed to permit entry of a needle therebetween during a warp drawing operation has a reed opener blade, a reed opener body and means to retain the reed opener blade and reed opener body in cooperative relationship such that the blade and body combine to form a cam surface for successively engaging and spreading adjacent dents of a reed.

13 Claims, 6 Drawing Figures

REED OPENER ASSEMBLY

BACKGROUND OF THE INVENTION

This invention relates to warp drawing machines. Particularly, the invention relates to reed openers used in warp drawing machines for spreading the dents of a reed to permit entry of a warp drawing needle therebetween so that warp strands can be drawn through the reed. A typical warp drawing machine is provided with supports for heddle frames carrying a plurality of heddles, the reed, and a carriage arranged to travel longitudinally of the heddle frames and reed. The carriage is provided with mechanisms for selecting and positioning heddles and a reed opener for spreading the dents of the reed to facilitate drawing a warp strand through the reed and the eyes of the heddles.

In existing warp drawing machines, the reed opener is typically in the form of a single thread screw which by its rotation successively opens the dents of the reed by spreading the dents sufficiently to permit the needle to pass therethrough. Such a reed opener is shown in Howard D. Colman's U.S. Pat. No. 1,589,587. This single thread forms a cam surface which successively engages individual dents of the reed and deforms the engaged dent to spread adjacent dents in response to rotation of the reed opener.

In existing reed openers, the single thread screw or cam surface is formed from a single piece and has the disadvantage of being costly to manufacture. A further disadvantage is that different reed openers must be used to accommodate reeds having different spacing between dents.

There has long been a need for a reed opener which can be manufactured at low cost and which is adaptable for use in connection with reeds having varying dent spacings.

SUMMARY OF THE INVENTION

The instant invention solves the foregoing problems by providing a reed opener assembly having discreet components which are of simple construction and are easily manufactured. The reed opener assembly of the invention is provided with a reed opener body, a reed opener blade and retaining means for retaining the reed opener blade in cooperative relationship with the reed opener body so as to provide a cam surface for engaging and spreading the dents of a reed in response to rotation of the reed opener assembly. The reed opener blade of the preferred embodiment comprises a blade portion having a leading edge for entering between adjacent dents. The blade is also provided with a trailing portion having a trailing edge offset from the plane of the blade such that the surface of the trailing portion is inclined to the plane of the blade and forms a portion of the dent-engaging cam surface.

The reed opener body comprises an opening portion in the form of a portion of a disc. The opening portion is provided with a leading edge and an associated leading portion, a surface of the leading portion being tapered from the leadng edge to a planer surface of the opening portion.

The reed opener blade is located with respect to the reed opener body such that the trailing edge of the reed opener blade is proximate to the leading edge of the opening portion so that the trailing portion of the reed opener blade and the leading portion of the opening portion cooperate to form a transfer surface comprising a portion of the cam surface for transferring an engaged dent from a surface of the opening blade to a surface of the opening portion in response to rotation of the reed opener assembly.

To facilitate retaining the opener blade in cooperative relationship with the reed opener body, the reed opener body may be provided with a hub extending substantially perpendicular to a side of the flange portion and the reed opener blade may be provided with a mounting portion preferably having an opening therethrough for receiving the hub. When assembled, the reed opener blade is placed on the hub and properly oriented, suitable means being employed to retain the reed opener blade in cooperative relationship with the flange portion. To accommodate variations in dent spacing of individual reeds the reed opener assembly may be further provided with a spacer located between the reed opener blade and the flange portion.

A more thorough understanding of the advantages and features of the invention will be obtained from the following detailed description taken in conjunction with the drawing figures.

DESCRIPTION OF THE PREFERRED EMBODIMENT

Figure 1:
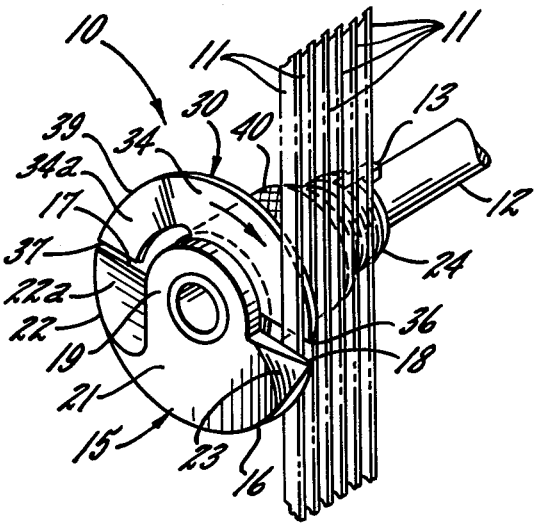
FIG. 1 is a perspective view of a preferred embodiment of a reed opener assembly according to the invention shown in operative relationship to a plurality of dents of a reed.

Referring now to the drawing figures and more particularly to FIG 1, a reed opener assembly generally indicated at 10, is shown in operative relationship with a plurality of reed dents 11 as used in a typical warp drawing machine (not shown). Assembly 10 may be mounted on rotatable shaft 12 and retained in position in any suitable fashion, as by means of a key 13. Shaft 16 is rotatably driven in conventional manner during operation of the warp drawing machine. Reed opener assembly 10 comprises a reed opener body 15, a reed opener blade 30, and a retaining means, such as nut 40, for retaining blade 30 in cooperative relationship with reed opener body 15.

Figure 2:
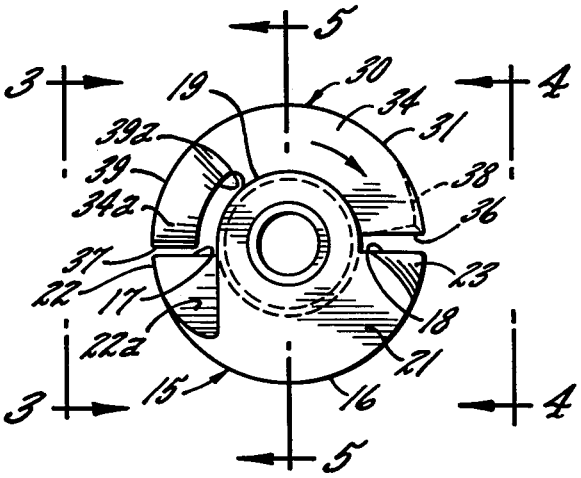
FIG. 2 is an end view of the reed opener assembly of FIG. 1.
Figure 6:
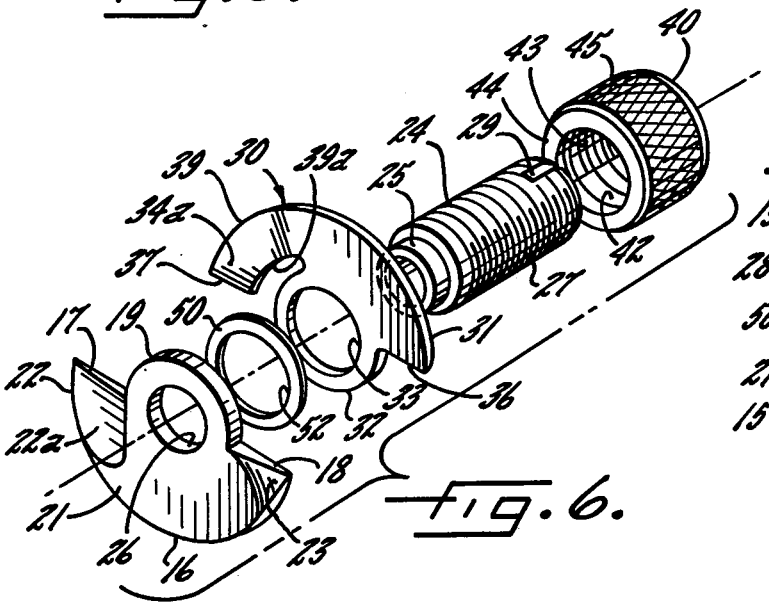
FIG. 6 is an exploded view of a preferred embodiment of a reed opener assembly according to the invention.
Figure 5:
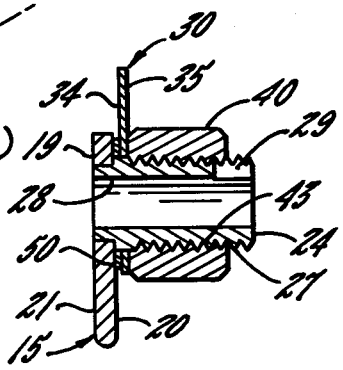
FIG 5 is a sectional view of the reed opener assembly of FIG. 2 taken along line 5—5.

As best seen in FIGS. 1, 2 and 6, reed opener body 15 comprises an opening portion 16 preferably in the form of a portion of a disc having, with respect to the indicated direction of rotation, a leading edge 17 and a trailing edge 18. As shown, opening portion 16 is approximately semi-circular in shape, but it will be apparent that other configurations may be satisfactorily employed. Reed opener body 15 may also be provided with a mounting flange 19 integral with opening portion 16 and also being generally semi-circular in shape but of lesser diameter than opening portion 16. Mounting flange 19 and opening portion 16 preferably have common inner and outer surfaces 20, 21 thereby simplifying design and fabrication. Mounting flange 19 and a portion of opening portion 16 may serve as an abutment against which other components of reed opener assembly 10 may be retained. The leading portion 22 of opening portion 16 preferably has a tapered surface 22*a*, as shown in FIGS. 1, 2, 3 and 6, which tapers toward inner surface 20 from outer surface 21 to leading edge 17. Leading edge 17 is thus reduced in thickness with respect to the major portion of opening portion 16. As will be more fully described below, tapered surface 22*a* forms at least a portion of a cam surface for engaging and spreading the dents of a reed. Opening portion 16 is further provided with another tapered surface 23 extending toward inner surface 20 from outer surface 21 to trailing edge 18 to facilitate smooth disengagement of the dent as assembly 10 rotates.

In order to facilitate assembly of reed opener assembly 10, reed opener body 15 is provided with a substantially cylindrical mounting hub 24 extending substantially perpendicular from inner surface 20 of mounting flange 19 and opening portion 16. Hub 24 may be integral with flange 19 and portion 16, but as shown in the exploded view of FIG. 6 hub 24 may also be a discreet component. To facilitate assembly of reed opener body 15, hub 24 may include a post 25 adapted to be inserted and retained in opening 26 in suitable fashion, as by press-fit. Hub 24 additionally has a threaded portion 27 to accommodate a retaining means as will be described below. Reed opener body 15 is preferably further provided with an opening or bore 28 extending therethrough and an associated keyway 29 to facilitate operative mounting of the reed opener assembly 10 in a warp drawing machine.

Reed opener blade 30, as best seen in FIGS. 1, 2 and 6, comprises a thin blade portion 31 and a mounting portion 32 which is preferably substantially circular in shape and provided with an opening 33 therethrough. In the preferred embodiment, reed opener blade 30 is predominantly flat, blade portion 31 and mounting portion 32 having common inner and outer surfaces 34, 35. Blade portion 31 may be of any suitable configuration but as shown is approximately semi-circular in shape and has a leading edge 36 and a trailing edge 37. Leading edge 36 preferably has associated beveled surfaces 38 to facilitate entry of edge 36 between dents of a reed as will be more fully explained below. According to the preferred embodiment, blade portion 31 is also provided with a trailing portion 39, defined by trailing edge 37 and cutout 39*a*, which is deformed or bent in any suitable fashion to offset trailing edge 37 from the plane of reed opener blade 30 so that a surface 34*a* of trailing portion 39 is inclined to form at least a portion of a cam surface suitable for engaging and spreading the dents of a reed as more fully described below.

In the preferred embodiment, the means for retaining blade 30 and opening portion 16 in operative relationship comprises nut 40 having an opening 42 therethrough, opening 42 being provided with a threaded portion 43 so that nut 40 may be threaded on mounting hub 24. When reed opener assembly 10 is assembled, surface 44 of nut 40 will engage outer surface 35 of reed opener blade 30 so as to retain blade 30 in the desired assembled position. If desired, the external surface 45 of nut 40 may be knurled to facilitate tightening of nut 40.

Depending upon reed dent spacing and other warp drawing parameters, one or more spacers 50 of suitable thickness may be positioned between opening portion 16 and reed opener blade 30. Spacer 50 may comprise a flat, circular washer or shim having an opening 52 therethrough large enough so that spacer 50 may pass over hub 24. The use of such spacers will permit the manufacture and use of identical reed opener bodies 15 and reed opener blades 30 in conjunction with reeds of various gages.

Figure 3:
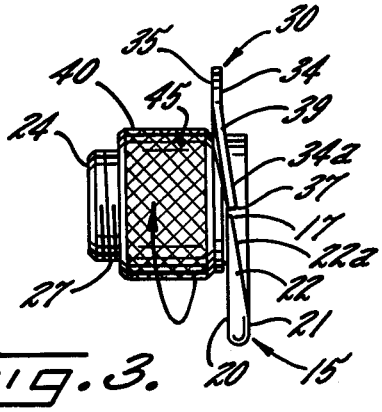
FIG 3 is a side view of the reed opener assembly of FIG. 2 taken in the direction of line 3—3.
Figure 4:
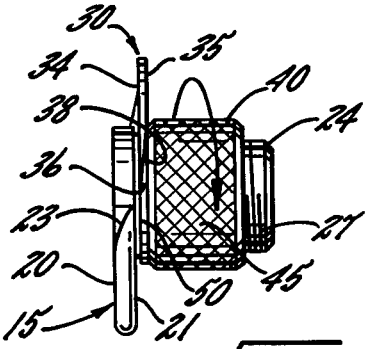
FIG. 4 is a side view of the reed opener assembly of FIG. 2 taken in the direction of line 4—4.

In use, reed opener body 15 and reed opener blade 30 are assembled in cooperative relationship so as to form a suitable cam surface for engaging and spreading the dents of a reed in response to rotation of reed opener assembly 10. Reed opener blade 30 is located on mounting hub 24 such that hub 24 extends through opening 33 of mounting portion 32, inner surface 34 of reed opener blade 30 being adjacent to inner surface 20 of reed opener body 15 if a spacer 50 is not employed. Reed opener blade 30 is positioned so that trailing edge 37 is proximate to leading edge 17 of opening portion 16, as best seen in FIGS. 1, 2 and 3. It is thus seen that surface 34*a* of trailing portion 34 and tapered surface 22*a* of opening portion 16 comprise a portion of a cam surface, which may be referred to as a transfer surface, suitable for transferring engagement of a reed dent from inner surface 34 of blade portion 31 to outer surface 21 of opening portion 16 as reed opener assembly 10 is rotated.

Once reed opener blade 30 is properly positioned with respect to reed opener body 15, retaining means or nut 40 is threaded onto hub 24 to secure at least mounting portion 32 of blade 30 against at least mounting flange 19 of reed opener body 15. Of course, if a spacer 50 is used in the assembly it will be located between mounting portion 32 and mounting flange 19, both of blade 30 and spacer 50 being retained in position by nut 40.

In the end view of reed opener assembly 10 shown in FIG. 2 it will be noted that gaps are present between leading edge 36 of blade portion 31 and trailing edge 18 of opening portion 16 as well as between trailing edge 37 and leading edge 17. These gaps may be desirable based on design considerations but are not particularly critical so long as the design provides for suitable engagement and disengagement of reed dents as assembly 10 rotates. For instance, any gap present between edges 17 and 37 must not be so large that an engaged dent can pass through the gap and become disengaged in mid-cycle.

The operation of reed opener assembly 10 can best be understood with reference to FIG. 1. When reed opener assembly 10 is used in a warp drawing machine it is simultaneously rotated and moved laterally, as indicated, by a carriage in the warp drawing machine. As assembly 10 rotates leading edge 36 enters between a pair of adjacent reed dents 11 and a portion of surface 34 of blade portion 31 may engage one of the dents. As assembly 10 rotates further, the engaged dent is successively engaged by surfaces 34*a*, 22*a* and 21, which comprise a suitable cam surface, so that the pair of adjacent dents are spread far enough apart to permit entry of a warp drawing needle therebetween. As rotation and lateral movement continues reed opener assembly will operate on successive pairs of adjacent reed dents in similar fashion. The tapered surface 23 associated with trailing edge 18 of opening portion 16 may be provided to facilitate a rather smooth disengagement of the reed dents as reed opener assembly 10 rotates out of engagement with the dent.

In the foregoing discussion of the preferred embodiment, the transfer surface portion of the cam surface employed to bring a reed dent from inner surface 34 of blade portion 31 to outer surface 21 of opening portion 16 comprises inclined surfaces of both blade portion 31 and opening portion 16, namely surface 34*a* and surface 22*a*, respectively. This transfer surface could be completely formed by either blade portion 31 or opening portion 16. For instance, if leading edge 17 of opening portion 16 extended from inner surface 20 to outer surface 21 without provision for tapered surface 22*a*, trailing portion 39 of blade portion 31 could be deformed further so that trailing edge 37 is offset sufficiently to be proximate to outer surface 21 of opening portion 16 when in the assembled position. In such case, surface 34*a* of trailing portion 39 would form the required transfer surface portion of the cam surface. Similarly, a reed opener blade could be provided in which trailing portion 39 is not deformed and trailing edge 37 lies in the plane of blade portion 31. In such case, tapered surface 22*a* of opening portion 16 could be formed so that it extends to inner surface 34 of blade portion 31 when in the assembled position.

While blade portion 31 and opening portion 16 are shown as being approximately semi-circular in shape and being assembled in opposing fashion so as to form a substantially complete circle, it is not necessary that blade portion 31 and opening portion 16 be designed in this manner. A principal feature is that reed opener body 15 and reed opener blade 30 be designed as discreet components which, when assembled, cooperate with one another to form a cam surface suitable for engaging and spreading dents of a reed as reed opener assembly 10 is rotated. It will be readily apparent that numerous modifications and alternate embodiments are possible without departing from the scope and spirit of the invention. Thus, the preferred embodiment disclosed herein is to be considered exemplary only and the invention is limited solely by the claims.

I claim:

1. A reed opener assembly for use in a warp drawing-in machine having means for providing relative longitudinal movement of the reed opener assembly with respect to a reed supported in the machine and means for selectively rotating the reed opener assembly, said reed opener assembly having a cam surface for successively engaging the dents of a reed so as to spread adjacent dents in response to rotation of said reed opener assembly, and comprising: a reed opener blade comprising a blade portion having a leading edge for entering a reed between adjacent reed dents; a reed opener body comprising a portion of a disc, a surface of said disc portion forming at least a portion of said cam surface; and means to retain said reed opener blade in cooperating relationship with said reed opener body to form said cam surface.

2. A reed opener assembly according to claim 1 wherein said cam surface comprises a transfer surface extending from a surface of said blade portion to a surface of said disc portion.

3. A reed opener assembly according to claim 2 wherein said blade portion comprises a trailing portion and said disc portion comprises a leading portion, a surface of one of said trailing portion and said leading portion comprising at least a portion of said transfer surface.

4. A reed opener assembly according to claim 3 wherein a surface of said trailing portion comprises a first portion of said transfer surface and a surface of said leading portion comprises a second portion of said transfer surface.

5. A reed opener assembly according to claim 4 wherein said trailing portion has a trailing edge offset from the plane of said blade portion, said first portion of said transfer surface comprising a surface of said trailing portion.

6. A reed opener assembly according to claim 4 wherein said blade portion of said reed opener blade comprises a portion of a second disc.

7. A reed opener assembly according to claim 4 wherein said leading portion comprises a reduced thickness leading edge and a surface tapered from said leading edge to a side of said disc portion, said second portion of said transfer surface comprising said tapered surface.

8. A reed opener assembly according to claim 7 wherein said trailing portion comprises a trailing edge offset from the plane of said blade portion, said trailing edge located proximate to said leading edge of said leading portion of said disc portion, said transfer surface comprising said tapered surface and a surface of said trailing portion.

9. A reed opener assembly according to claim 1 wherein said reed opener body additionally comprises a hub projecting from a side of said disc portion, said reed opener blade additionally comprising a mounting portion associated with said blade portion and adapted to be mounted on said hub.

10. A reed opener assembly according to claim 9 wherein said retaining means comprises a retaining surface for engaging a surface of said opener blade and retaining said reed opener blade proximate to said side of said disc portion.

11. A reed opener assembly according to claim 9 wherein said mounting portion has an opening therethrough to receive said hub.

12. A reed opener assembly according to claim 9 wherein said hub has a threaded end portion and said retaining means has a threaded portion for threadingly engaging said threaded end portion.

13. A reed opener assembly according to claim 1 additionally comprising a spacer located between blade portion and said disc portion.

* * * * *